US006707237B2

(12) United States Patent
Teramura et al.

(10) Patent No.: US 6,707,237 B2
(45) Date of Patent: Mar. 16, 2004

(54) SPARK PLUG

(75) Inventors: Hideki Teramura, Nagoya (JP); Mamoru Musasa, Nagoya (JP); Junichi Kagawa, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 10/216,800

(22) Filed: Aug. 13, 2002

(65) Prior Publication Data

US 2003/0071552 A1 Apr. 17, 2003

Related U.S. Application Data

(63) Continuation-in-part of application No. PCT/JP01/01084, filed on Feb. 15, 2001.

(30) Foreign Application Priority Data

Feb. 16, 2000 (JP) ..... 2000-037888

(51) Int. Cl.[7] ..... H01T 13/20
(52) U.S. Cl. ..... 313/143; 313/141
(58) Field of Search ..... 313/141, 143

(56) References Cited

U.S. PATENT DOCUMENTS 4,700,103 A 10/1987 Yamaguchi et al.
5,510,667 A 4/1996 Loffler et al.

FOREIGN PATENT DOCUMENTS

| | | |
|---|---|---|
| JP | 61-45583 | 3/1986 |
| JP | 2-26356 | 6/1990 |
| JP | 4-138685 | 5/1992 |
| JP | 5-159856 | 6/1993 |
| JP | 5-242955 | 9/1993 |
| JP | 6-13157 | 1/1994 |
| JP | 7-37675 | 2/1995 |
| JP | 7-37676 | 2/1995 |
| JP | 9-129356 | 5/1997 |
| JP | 2554973 | 8/1997 |

*Primary Examiner*—Vip Patel
(74) *Attorney, Agent, or Firm*—Sughrue Mion, PLLC

(57) ABSTRACT

A spark plug is disclosed, in which a center electrode has, at the end thereof which forms a spark discharge gap, a noble metal chip which has a straight rod portion of 1.0 mm or less in diameter and 0.2 mm or more in length; width of coverage K of a ground electrode on which a rectangular noble metal chip is welded satisfies a relation of $-d \leqq K \leqq 0.5$ mm (where, d represents the diameter of the end face of the center electrode); and width w of a portion of the discharge plane 111A which falls within a range corresponded to the axial extension of the end face 22B of the noble metal chip 22 provided on the center electrode 2 satisfies a relation of $w<2.1-K$ (in mm), where K is the foregoing width of coverage.

6 Claims, 11 Drawing Sheets

Ignitability test

Low-temperature startability test

Fig. 11 width w of discharge plane (mm)

| width of coverage K (mm) | 0.5 | 0.6 | 0.7 | 0.8 | 0.9 | 1.0 | 1.1 | 1.2 | 1.3 | 1.4 | 1.5 | 1.6 | 1.7 | 1.8 | 1.9 | 2.0 | 2.1 | 2.2 | 2.3 | 2.4 | 2.5 | 2.6 | 2.7 | 2.8 |
|---|---|---|---|---|---|---|---|---|---|---|---|---|---|---|---|---|---|---|---|---|---|---|---|---|
| -0.7 | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ○ | ○ | ○ | ○ | × |
| -0.6 | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ○ | ○ | ○ | ○ | × | × |
| -0.5 | ◎ | ◎ | ◎ | ◎ | ◎ | ◎ | ◎ | ◎ | ◎ | ◎ | ◎ | ◎ | ◎ | ◎ | ◎ | ◎ | ◎ | ○ | ○ | ○ | ○ | × | × | × |
| -0.4 | ◎ | ◎ | ◎ | ◎ | ◎ | ◎ | ◎ | ◎ | ◎ | ◎ | ◎ | ◎ | ◎ | ◎ | ◎ | ◎ | ○ | ○ | ○ | ○ | × | × | × | × |
| -0.3 | ◎ | ◎ | ◎ | ◎ | ◎ | ◎ | ◎ | ◎ | ◎ | ◎ | ◎ | ◎ | ◎ | ◎ | ◎ | ○ | ○ | ○ | ○ | × | × | × | × | × |
| -0.2 | ◎ | ◎ | ◎ | ◎ | ◎ | ◎ | ◎ | ◎ | ◎ | ◎ | ◎ | ◎ | ◎ | ◎ | ○ | ○ | ○ | ○ | × | × | × | × | × | × |
| -0.1 | ◎ | ◎ | ◎ | ◎ | ◎ | ◎ | ◎ | ◎ | ◎ | ◎ | ◎ | ◎ | ◎ | ○ | ○ | ○ | ○ | × | × | × | × | × | × | × |
| 0.0 | ◎ | ◎ | ◎ | ◎ | ◎ | ◎ | ◎ | ◎ | ◎ | ◎ | ◎ | ◎ | ○ | ○ | ○ | ○ | × | × | × | × | × | × | × | × |
| 0.1 | ◎ | ◎ | ◎ | ◎ | ◎ | ◎ | ◎ | ◎ | ◎ | ◎ | ◎ | ○ | ○ | ○ | ○ | × | × | × | × | × | × | × | × | × |
| 0.2 | ◎ | ◎ | ◎ | ◎ | ◎ | ◎ | ◎ | ◎ | ◎ | ◎ | ○ | ○ | ○ | ○ | × | × | × | × | × | × | × | × | × | × |
| 0.3 | ◎ | ◎ | ◎ | ◎ | ◎ | ◎ | ◎ | ◎ | ◎ | ○ | ○ | ○ | ○ | × | × | × | × | × | × | × | × | × | × | × |
| 0.4 | ◎ | ◎ | ◎ | ◎ | ◎ | ◎ | ◎ | ◎ | ○ | ○ | ○ | ○ | × | × | × | × | × | × | × | × | × | × | × | × |
| 0.5 | ◎ | ◎ | ◎ | ◎ | ◎ | ◎ | ◎ | ○ | ○ | ○ | ○ | × | × | × | × | × | × | × | × | × | × | × | × | × |

SPARK PLUG

This is a Continuation-In-Part of PCT Application No. PCT/JP01/01084 tiled Feb. 15, 2001; the disclosure of which is incorporated herein by reference.

FIELD OF THE INVENTION

The present invention relates to a spark plug available as an ignition device for internal combustion engine, and more specifically to a spark plug capable of promoting rupture of fuel bridge if it should occur so as to fill a spark discharge gap, to thereby successfully suppress degradation in the ignition property.

DESCRIPTION OF THE BACKGROUND ART

Conventional spark plug generally comprises a center electrode protruded downward from the end face of an insulator, and a ground electrode joined at one end thereof to a metal shell, and is composed so as to form a spark discharge gap between the end face of the center electrode and ground electrode, where electric spark generated in the gap ignites mixed fuel gas. To improve startability of the spark plug at low temperature, it has been a general practice for internal combustion engine to raise concentration of fuel-air mixture sucked into a combustion chamber.

Suction of a fuel-air mixture of higher concentration aiming at improving the startability at lower temperature, however, tends to cause accumulation of the fuel in a liquid state within pistons. The accumulated fuel may adhere on the surface of the spark plug or fill the spark discharge gap in conjunction with reciprocating motion of the pistons at the starting, which results in formation of fuel bridge at the spark discharge gap. Since the fuel is electro-conductive, such formation of fuel bridge at the spark discharge gap will be causative of leakage of current even if a high voltage is applied to the spark discharge gap, and will prevent electric spark from being generated at the spark discharge gap. The fuel-air mixture after sucked into a combustion chamber will therefore not be ignited, which undesirably degrade the startability contrary to expectation.

It is therefore an object of the present invention to provide a spark plug which is less causative of the fuel bridge at the spark discharge gap even when the above-described, hyper-concentration, fuel-air mixture is supplied.

SUMMARY OF THE INVENTION

The present invention relates to a spark plug which comprises an insulator (1) having a center through hole (1D); a center electrode (2) disposed in the center through hole (1D) and extends along the direction of axial line (O); a metal shell (5) having a screw (5B) for assembling an internal combustion engine provided external of the insulator (1); and a ground electrode (11) joined at one end thereof through a joint portion (55) to the metal shell (5), and on the other end of which having a discharge plane (111A) being arranged so as to oppose to an end face (22B) of the center electrode (2) to thereby form a spark discharge gap (g); and which spark plug is characterized, wherein the insulator (1) is engaged to the metal shell (5) through an engagement portion (15), and the center electrode (2) is protruded out from an end face (1E) of the insulator (1) and has formed therein a divergent portion (G), having a diameter increasing towards the end, on the end side beyond such engagement portion (15) and between the outer peripheral surface of the center electrode (2) and the inner peripheral surface of the insulator (1); Moreover, the end of the center electrode (2) forming the spark discharge gap (g) comprises a noble metal member (22) having a straight rod portion (22A) of 1.0 mm or less in diameter and 0.2 mm or more in length; and assuming a primary intersectional line (PKL) as being defined as an intersectional line formed between the end face (22B) of the center electrode (2) or a plane (P1) extended therefrom and a lateral plane (22S) of the straight rod portion (22A) or a cylindrical plane (C1) extended therefrom;

further assuming a secondary intersectional line (SKL) as being defined as an intersectional line formed between the discharge plane (111A) or a plane (P2) extended therefrom and an end face (112B) of the ground electrode (11) or a plane extended therefrom;

further assuming a primary virtual line (PVL) as being defined as a virtual line containing a primary intersectional point (PP) and being in parallel to a virtual center axial line (O) of the spark plug referring to the screw (5B) for assembling the internal combustion engine, wherein the primary intersectional point (PP) is a first point encountered the primary intersectional line (PKL)when a standard line (SL) parallel to the virtual center axial line (O) is moved across the spark discharge gap (g) to the joint portion 55 of the ground electrode (11) from the side opposite to such joint portion (55) placing the virtual center axial line (O) in between; and further assuming a secondary virtual line (SVL) as being defined as a virtual line containing a secondary intersectional point (SP) and being in parallel to the virtual center axial line (O), wherein the secondary intersectional point (SP) is a last point where the standard line (SL) similarly moved intersects with the primary intersectional line (PKL);

a width of coverage (K) as being defined as a distance between the primary virtual line (PVL) and secondary intersectional line (SKL) is set so as to satisfy a relation of $$-d \leqq K \leqq 0.5 \text{ (in mm)} \quad (1)$$

(in mm: where d represents the diameter of the end face (22B) of the center electrode (2); and sign for K is defined as negative when the secondary intersectional line (SKL) stands closer to the joint portion (55) than the primary virtual line (PVL), and as positive when stands further); and the width (w) of a portion of the discharge plane (111A) which falls within a range (WDS) between the secondary virtual line (SVL) and primary virtual line (PVL) satisfies a relation of $$w < 2.1 - K \text{ (in mm)} \quad (2)$$

where K is the foregoing width of coverage.

It should now be noted that reference numerals and alphabets assigned to the individual constituents given in the Claims of the invention and in this section (SUMMARY OF THE INVENTION) were quoted from those used for the corresponded constituents shown in the attached drawings (FIGS. 1, 2 and 12), which are merely for the purpose of facilitating understanding of the present invention, and by no means limit the concept of the individual constituents in the present invention.

According to the foregoing constitution, the fuel bridge is likely to rupture even if it should occur at the spark discharge gap, since areas for the fuel contact on the ground electrode and center electrode are reduced. More specifically, at the beginning of the operation, a starter motor cranks to allow admission of fuel-air mixture into a combustion chamber. Although use of a hyper-concentrated fuel-air mixture inevitably causes the fuel bridge at the spark discharge gap in conjunction with the motion of the pistons at the start time, the fuel bridge in the spark plug of the present invention is likely to rupture by vibration applied when the cranking is further sustained.

The spark plug is generally attached to an internal combustion engine so as to direct the side of the spark discharge gap downward. The fuel bridge generated at the spark discharge gap is sustained so that the liquid droplet of the fuel is suspended by adhesive force effected between such liquid droplet and the center electrode. Since the spark plug is designed so as to reduce the diameter of the end of the center electrode as small as 1.0 mm or less, which reduces an area for retaining the fuel droplet, so that the bridge will readily be ruptured even if it should undesirably be formed. It is also worth while pointing out that the center electrode has a straight rod portion of 0.2 mm or above in length, and that the rear side of such portion is connected to a divergent portion of the center electrode. Since the fuel bridge once formed with a hyper-concentrated fuel-air mixture extends over the side face of the center electrode, so that the elongation of the straight rod portion is advantageous in that preventing the fuel from spreading over a transitional portion towards the divergent portion. This successfully downsizes the area for retaining the fuel droplet and thus reduces retention force effected between the center electrode and liquid droplet, which makes the fuel bridge more likely to rupture. In addition, composing the end portion of the center electrode with a noble metal will desirably suppress the wear due to spark discharge, which makes it possible to suppress deformation due to the wear during long-term use, and to retain the easiness in rupture of fuel bridge for a long period. Noble metals exemplified herein include not only Pt and Ir, but also those having a melting point of 1,600° C. or above such as Pt alloys and Ir alloys which are typified by Pt—Ir, Ir—Rh, Ir—Pt, and Ir—$Y_2O_3$.

The width of coverage K can be measured using a projector (as typically shown in FIG. 2B, measured based on a projection onto a projection plane in parallel both to a direction of the spark discharge gap (g) as seen from the joint portion (55) of the ground electrode (11) and to the center axis O). The outer peripheries of some discharge planes may be rounded or chamfered. For this case, an intersectional line formed by planes extended from the discharge plane and extended from the side face of the discharge-plane-forming portion (base member for the ground electrode or the protruded portion made of a noble metal) will serve as a boundary line based on which the width of discharge plane is discussed. In some other cases, a burr ascribable to cutting of the noble metal member may protrude into a portion of the primary intersectional line. For such case, the primary intersectional line must be imaged assuming that the burr has removed. Further for the case in which a rectangular wire is cut at predetermined intervals along the longitudinal direction to thereby produce the ground electrode, thus-produced cut plane which serves as an end face of the ground electrode may have steps ascribable to the cutting. For this case, it is to be defined that the secondary intersectional line is set on the basis of the end face closest to the discharge plane.

In the spark plug of the present invention, the width of coverage (K), defined as a distance between the primary virtual line (PVL) and secondary intersectional line (SKL) is set so as to satisfy the foregoing formula ①, which expresses $-d \leqq K \leqq 0.5$ . The width of coverage K corresponds to a distance between the end face of the ground electrode and a virtual line (primary virtual line (PVL)) drawn at the position furthest from the joint portion with the ground electrode to the outer periphery of the end face of the center electrode in the axial direction. It is also to be defined that the width W of a portion of said discharge plane (111A) which falls within a range (WDS) between the secondary virtual line (SVL) and primary virtual line (PVL) is set so as to satisfy the foregoing formula ②, which expresses $w<2.1-K$.

If the width of coverage K falls less than −d, the side face of the end portion of the center electrode will oppose to the end face of the ground electrode. Such constitution is disadvantageous in reducing the area from which the fuel droplet suspends, since the length of the straight rod portion which composes the end portion of the center electrode must be excessively long, and the divergent portion which extends from the straight rod portion must be narrow. This adversely affects the heat radiation from the straight rod portion and tends to promote the wear thereof due to spark discharge. And what is more, the tendency of the wear due to spark discharge is strong, since the area of the end face of the ground electrode cannot be set as to be so large. In the present invention, the width of coverage K is however set to −d or above so as to oppose the end face of the center electrode to the discharge plane of the ground electrode. This allows the fuel bridge to be formed only within a spark discharge gap between the end face of the center electrode and the discharge plane of the ground electrode, which is advantageous to avoid the foregoing failure. It is recommendable for this case that the portion around the end face of the center electrode and the discharge plane of the ground electrode have morphology capable of facilitating rupture of the fuel bridge.

On the other hand, the width of coverage K is set as 0.5 mm or less, and the width w of a range obtained by extending, along the direction of the axial line, the end face of a portion of the discharge plane of the ground electrode which falls within a range between the primary virtual line PVL and secondary virtual line SVL is limited to less than (2.1−K) mm, which successfully reduces the area on the side of the ground electrode on which the fuel droplet is retained during formation of the fuel bridge. Since the ground electrode supports the fuel droplet from the bottom thereof, reduction in the supporting area means reduction in supportable volume of the fuel droplet. This successfully allows the fuel bridge, if it should occur, to readily be ruptured by repetitive vibration. It should be noted now that retaining ability of the fuel droplet increases if the width of coverage K is large enough even if the width w of the ground electrode remains unchanged. The formula ① thus means that the larger the width of coverage K grows, the smaller the upper limit value of the discharge plane width w should be in order to suppress formation of the fuel bridge. Conversely saying, this also means that the fuel bridge does not tend to occur even if the discharge plane width w grows somewhat larger provided that the width of coverage K is kept small.

Such dimensional setting of the width of coverage K can also improve the ignition property. One factor largely affects the ignition property relates to quenching effect by the electrode. Even if the fuel-air mixture is once ignited by electric spark generated in the spark discharge gap, the electrode which resides in the vicinity of the ignited fuel-air mixture takes the heat away, which results in flame-out of the fuel-air mixture. In contrast, reducing the width of coverage as in the present invention can expel the electrode which is causative of the flame-out from the area containing the fuel-air mixture, which improves the ignition property, and further improves the startability at lower temperature. It will be more advantageous to compose the protruded portion of the ground electrode by joining rectangular small members as described later, which is convenient to reduce the width of coverage K.

Besides the reduction of quenching effect, another advantage relates to that it will not disturb the flame diffusion as described below. The fuel-air mixture once ignited as described in the above can diffuse in the combustion chamber. This allows the entire fuel-air mixture in the combustion chamber to combust to thereby obtain larger output with an improved efficiency. A large width of coverage K herein means that the ground electrode can act as a screen to thereby obstruct the diffusion, in the early stage thereof, of the fuel-air mixture ignited in the spark discharge gap into the combustion chamber. On the contrary, a width of coverage K exceeding 0.5 mm herein may undesirably accelerate wear of the ground electrode due to overheat.

An excessively small discharge plane width w may sometimes accelerate wear of the electrode due to an excessive voltage concentration on the discharge plane to thereby make it difficult to sustain a desirable lifetime of the electrode, so that the width w is preferably ensured typically at 0.5 mm or above. The discharge plane width w is more preferably set so as to satisfy a relation of $0.5 \leqq w < 1.7-K$ (in mm).

Next strategy relates to that the ground electrode (11) can have formed thereon, at a position opposed to the end face (22B) of the center electrode (2), a rectangular protruded portion (112) protruded from the surface (111A) of the base member, which composes the discharge plane of such ground electrode (11), towards the center electrode (2). Provision of such protruded portion on the surface (111A) of the base member of the ground electrode successfully restricts a portion on which the fuel droplet is likely to be retained only within an area close to the protruded portion. The volume of the fuel droplet possibly retained on the side of the ground electrode can thus be reduced, which more effectively prevents the fuel bridge from being formed. In order to enhance the foregoing effect, it is preferable that the protruded portion (112) is protruded 0.5 mm or more from the surface (111A) of the base member of the ground electrode.

It is also preferable that the area of the end face (112A) of the protruded portion (112) is larger than that of the end face (22B) of the center electrode (2). The fuel bridge can be ruptured only when the gravity effecting on the fuel droplet overwhelms the adhesive force for maintaining the bridge formation (for example, boundary tension between the droplet and the individual end faces). If the area of the end face of the protruded portion is smaller than that of the center electrode, the adhesive force, which is expressed between the center electrode and droplet when the fuel bridge is formed, will exceed the gravity effected to such droplet, which may make it difficult to rupture the fuel bridge. On the contrary, ensuring a larger area of the end face of the protruded portion than that of the center electrode will desirably avoid such nonconformity.

The protruded portion (112) can be composed of a noble metal member. The ground electrode generally kept at a potential higher than that of the center electrode can attract light-weight electrons when electric spark generates. The ground electrode will thus have only a limited range of wear, but is likely to be heated as compared to the center electrode since it is located more closer to the center of the combustion chamber, and may suffer from accelerated wear depending on the types of internal combustion engines. Composing the protruded portion which composes the discharge plane of the ground electrode with a noble metal member less likely to be worn can successfully suppress the deformation-by-wear of the protruded portion, and can ensure easy rupture of the fuel bridge over a long period. Noble metals available herein are similar to those composing the center electrode, which include not only Pt and Ir, but also those having a melting point of 1,600° C. or above such as Pt alloys and Ir alloys which are typified by Pt—Ir, Ir—Rh, Ir—Pt, and Ir—$Y_2O_3$.

According to the spark plug of the present invention, the insulator (1) can be engaged to the metal shell (5) through the engagement portion (15) so as to protrude the center electrode (2) out from the end face of the insulator (1). In this case, the spark plug is composed so as to form a divergent portion (G), having a diameter increasing towards the end, on the end side beyond the engagement portion (15) and between the outer peripheral surface of the center electrode (2) and the inner peripheral surface of the insulator (1).

Such constitution successfully ensures a large difference in diameter between the center electrode and the end portion of the insulator. As described in the above, the liquid-state fuel retained in the piston will be flung up in association with motion of the piston, and will be transferred to the spark plug. More specifically, the fuel is supplied to the ignition portion of the spark plug shown in FIG. 2B from the bottom side of the drawing. If the fuel is charged in a large amount, it adheres to the entire space formed between the end portion of the insulator and the ground electrode. When the cranking is sustained thereafter, the generated vibration will cause drop-off of the adhered fuel from the outermost side of the end portion of the insulator. When a large difference in diameter between the center electrode and the end portion of the insulator is ensured, such diameter differing portion can retain a large volume of fuel, which allows the fuel to readily drop as being affected by vibration in the cranking. Rupture of the fuel bridge is thus promoted since the fuel adhered at the end portion of the insulator can readily drop in the early stage of the cranking as described in the above.

The divergent portion (G) may be formed so that the diameter continuously increases along the axial direction thereof, or increases in a step-wise manner in two or more steps. Even for the case of step-wise increase overall, continuously increase partially in a midway section is also allowable. A method for generating difference in diameter may be any of those such that reducing the diameter of the end portion of the center electrode towards the end side, such that increasing the diameter of the through hole of the insulator in which the center electrode is inserted, and combination of these methods.

BRIEF DESCRIPTION OF THE DRAWINGS

FIG. 11 is a chart showing results of a detailed experiment for investigating into relation of bridge formability with width of coverage and with discharge plane width;

BEST EMBODIMENTS FOR CARRYING OUT THE INVENTION

The first embodiments of the present invention will be described hereinafter referring to attached drawings.

Figure 1:
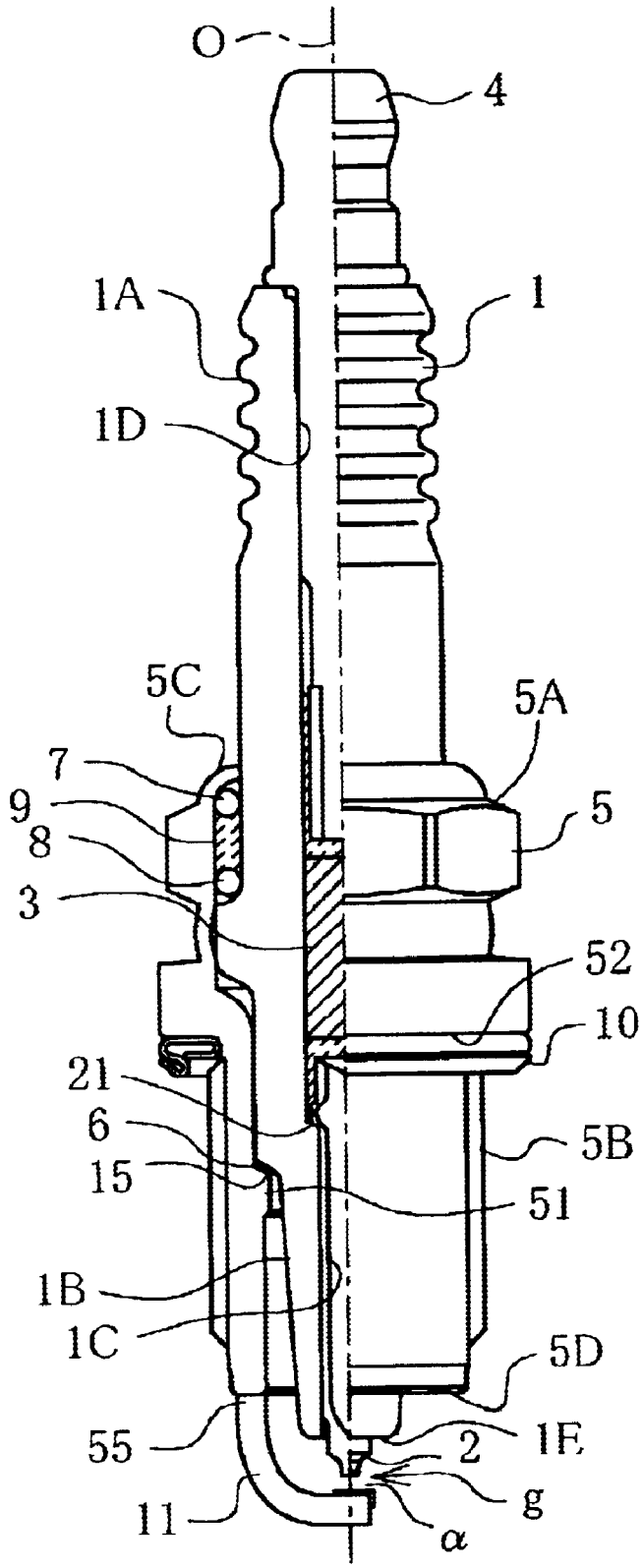
FIG. 1 is a partial sectional view of a spark plug according to the first embodiment of the present invention.
Figure 2A:
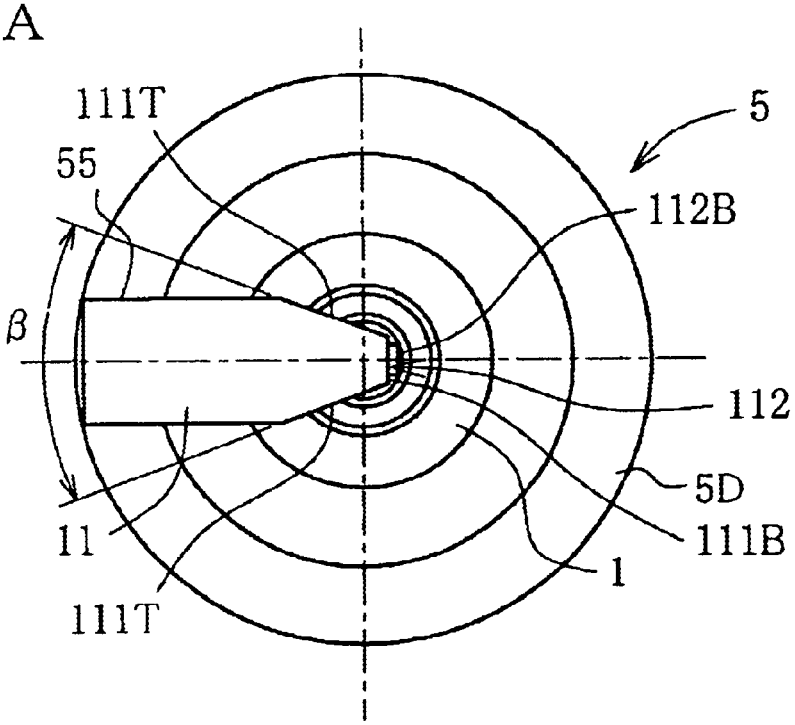
FIG. 2A is a plan view of a spark plug shown in FIG. 1.
Figure 2B:
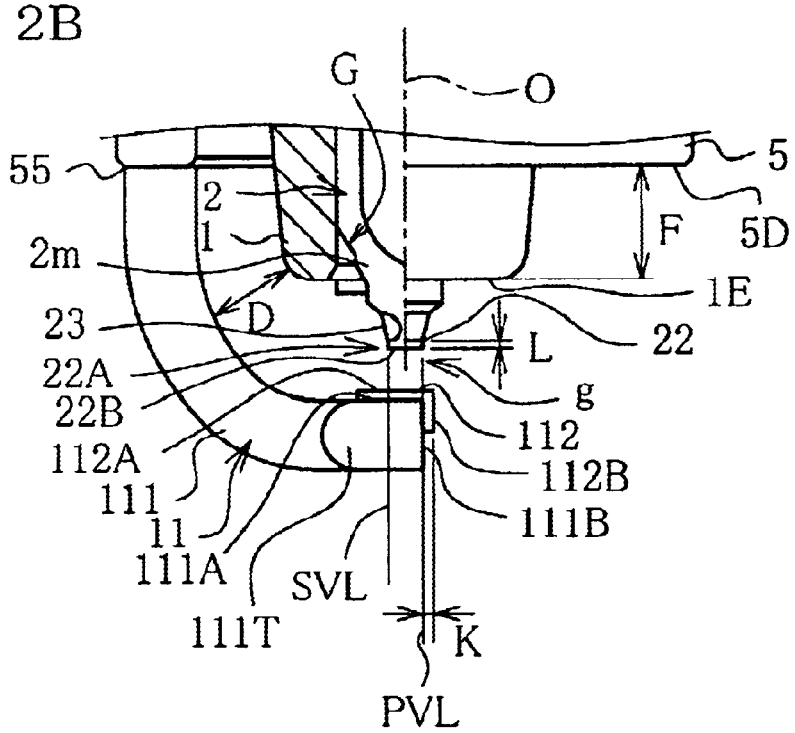
FIG. 2B is an enlarged partial sectional view showing an electrode and therearound of the spark plug shown in FIG. 1.

FIG. 1 is a partial sectional view of a spark plug according to the first embodiment of the present invention, and FIGS. 2A and 2B are enlarged views showing a principal portion of the spark plug. In the spark plug according to the first embodiment shown in FIG. 1, it is widely known that the insulator 1 made of alumina or the like has on the rear end portion thereof a corrugation 1A for ensuring a longer creeping distance, has on the front end portion thereof a long leg portion 1B to be exposed in a combustion chamber of an internal combustion engine, and has an insulator engagement portion 15 which is brought into contact with an engagement portion 51 swelling out into the inner side of a metal shell 5, and is supported by a caulking portion 5C. The insulator 1 has formed in the axial center thereof a front-side center through hole 1C having an almost constant diameter on the front end side beyond the insulator engagement portion 15, and has a rear-side center through hole 1D having a slightly larger diameter on the rear end side. At the step portion between the front-side center through hole 1C and rear-side center through hole 1D, a flange portion 21 of the center electrode 2 is engaged so as to allow the center electrode 2 to thrust from the end face 1E of the insulator 1. The center electrode 2 is shrunk in a step-wise manner (2 steps herein) at the end portion of the base member 2*m* thereof as shown in FIG. 2B to thereby form a convergent portion, and at the end of such convergent portion a noble metal chip 22 is joined as being interposed with a weld portion 23 formed by laser welding. The noble metal chip 22 is formed by placing a member of 0.7 mm in diameter and 0.8 mm in length on the end of the convergent portion of the base member 2*m* and joined thereto by laser welding so as to leave the straight rod portion 22A (typically having an axial length L of approx. 0.3 mm). The noble metal chip 22 will thus have a plane opposing to the ground electrode 11, which refers to the end face 22B of the center electrode 2, with an area as small as approx. 0.38 $mm^2$. The center electrode 2 is electrically connected to a terminal nut 4 placed on the top, as being interposed with a ceramic resistor 3 disposed in the center through hole 1C. The terminal nut 4 is connected with a high-tension cable, not shown, so as to be applied with a high voltage. Materials available for composing the noble metal chip 22 include not only Pt and Ir, but also those having a melting point of 1,600° C. or above such as Pt alloys and Ir alloys which are typified by Pt—Ir, Ir—Rh, Ir—Pt, and Ir—$Y_2O_3$. The present embodiment employs Ir-5 wt % Pt.

The metal shell 5 is made of a low-carbon steel, and comprises a hexagonal portion 5A capable of engaging with a spark plug wrench, and a screw portion 5B typically referred to as M14S. The metal shell 5 is caulked to the insulator 1 through the caulking portion 5C thereof so as to integrate such metal shell 5 with the insulator 1. In order to ensure a tight closure through caulking, a plate-formed packing member 6 and wire-formed sealing members 7, 8 are provided between the metal shell 5 and insulator 1, and a talc powder 9 is further filled between the wire-formed sealing members 7, 8. A gasket 10 is inserted and engaged at the rear end of the screw portion 5B, and more specifically on a bearing surface 52 of the metal shell 5.

As shown in FIG. 2B, the ground electrode 11 made of a nickel alloy is joined by welding to the end face 5D of the metal shell 5. The ground electrode 11 opposes with the end face 22B of the noble metal chip 22 formed on the center electrode 2 along the axial direction O, and thus forms a spark discharge gap g between the center electrode 2 and ground electrode 11.

The hexagonal portion 5A is designed to have a distance of opposing edges of 16 mm, and a length from the bearing plane 52 of the metal shell 5 to the end face 5D of 19 mm. The ground electrode 11 may have incorporated therein a good heat conductor made of Cu, pure Ni or composite materials thereof in order to lower temperature at the end portion thereof and to suppress the spark-induced wear.

The ground electrode 11 has the protruded portion 112 at the portion opposed to the end face 22B of the center electrode 2. The protruded portion 112 is provided at the end portion of the base member 111 for the ground electrode composed of a Ni alloy (Inconel 600, for example) so as to protrude from the surface composing the discharge plane 111A (side face opposing to the center electrode 2) towards the center electrode 2. In the present embodiment, the base member 111 for the ground electrode is formed therein a groove of 0.7 mm wide, 0.45 mm deep and 1.25 mm long, and in which groove the noble metal chip 112 having a size of 0.7 mm×0.7 mm×1.5 mm is fitted and fixed to the ground electrode 11 by resistance welding to thereby form the protruded portion 112A. The protruded portion 112 thus protrudes by approx. 0.25 mm in the longitudinal direction from the end face 111B of the base member 111 for the ground electrode, and also by approx. 0.25 mm in the height-wise (depth-wise) direction from the surface 111A opposing to the center electrode 2. Thus the plane 112A of the protruded portion 112 opposing to the center electrode 2 has an area of 1.05 $mm^2$, which is larger than the foregoing area (approx 0.38 $mm^2$) of the end face 22A of the center electrode 2.

Figure 12A:
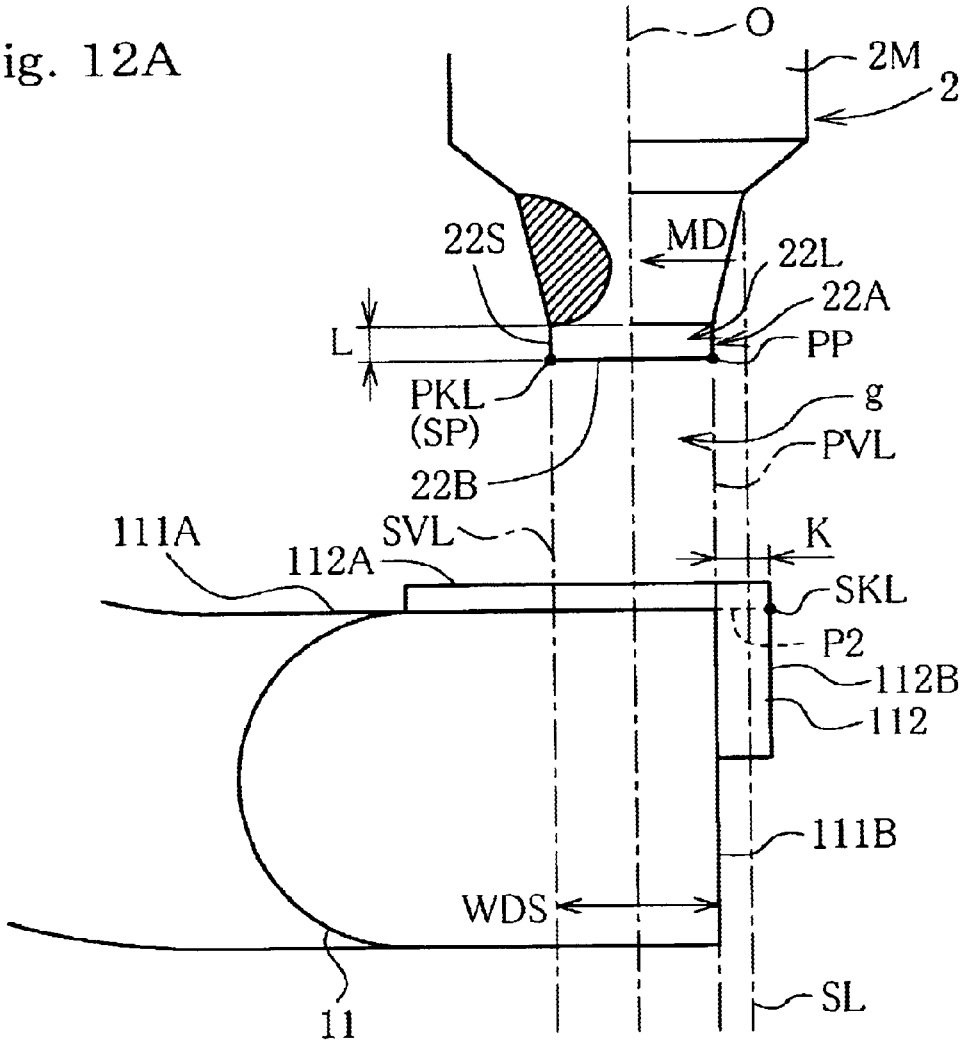
FIG. 12A is a further enlarged view of principal portion shown in FIG. 2B.
Figure 12B:
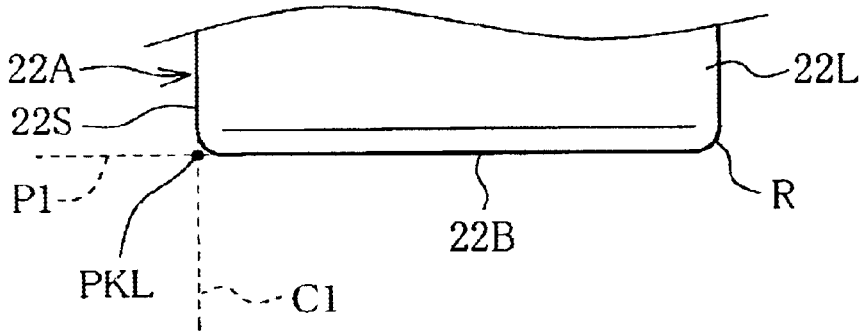
FIG. 12B is a schematic view showing a modified example of the end portion of the center electrode shown in FIG. 12A.

It is now assumed, as shown in FIG. 12A, that an intersectional line formed between the end face 22B of the center electrode 2 or a plane P1 extended therefrom (FIG. 12B: typically for the case in which the outer periphery of the end face 22B is rounded or tapered) and a lateral plane 22S of the straight rod portion 22A or a cylindrical plane C1 extended therefrom (FIG. 12B: ditto) is referred to as a primary intersectional line PKL; and that an intersectional line formed between the discharge plane 111A or a plane P2 extended therefrom and the end face 112B of the noble metal chip 112 or a plane extended therefrom is referred to as a secondary intersectional line SKL. It is also assumed that a virtual line containing a primary intersectional point PP and is in parallel to a virtual center axial line O of the spark plug referring to the screw 5B for assembling the internal combustion engine is referred to as a primary virtual line PVL, wherein the primary intersectional point PP is a first point encountered the primary intersectional line PKL when a standard line SL parallel to the virtual center axial line O is moved across the spark discharge gap g to the joint portion 55 of the ground electrode 11 from the side opposite to such joint portion 55 placing the virtual center axial line O in between; and that a virtual line containing a secondary intersectional point SP and is in parallel to the virtual center axial line O is referred to as a secondary virtual line SVL, wherein the secondary intersectional point SP is a last point where the standard line SL similarly moved intersects with the primary intersectional line PKL. The width of coverage K as being defined as a distance between the primary virtual line PVL and secondary intersectional line SKL is set so as to satisfy a relation of $-d \leqq K \leqq 0.5$ (in mm: where d represents the diameter of the end face 22B of the center electrode 2). The width w of a portion of the discharge plane which falls within a range WDS between the secondary virtual line SVL and primary virtual line PVL satisfies a relation of $w<2.1-K$ (in mm) where K is the foregoing width of coverage.

Figure 3A:
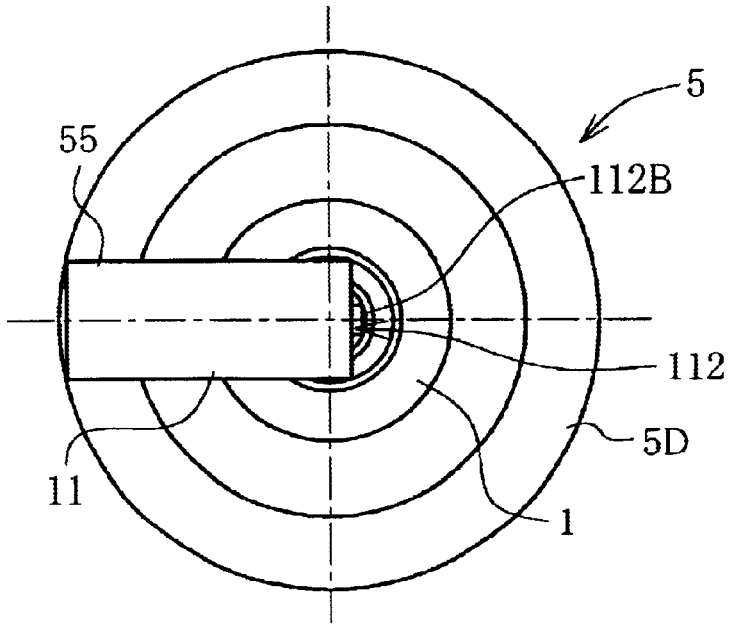
FIG. 3A is plan view of a spark plug according to the second embodiment of the present invention.
Figure 3B:
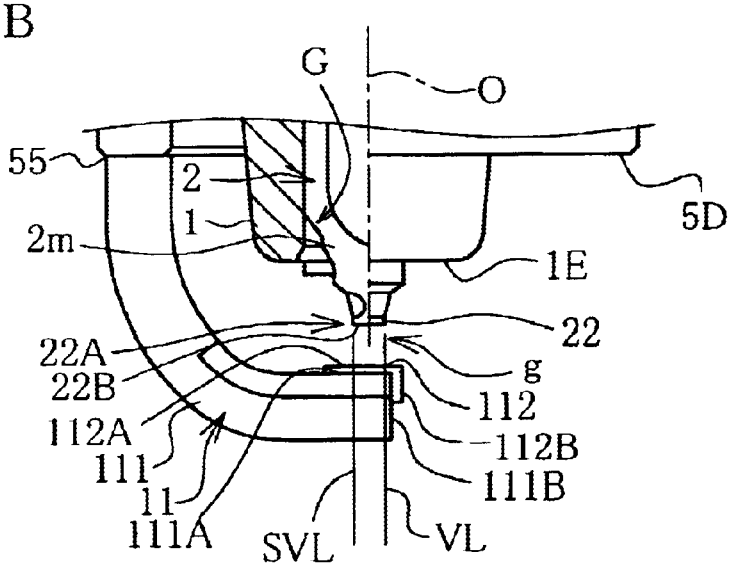
FIG. 3B is an enlarged partial sectional view showing an electrode and therearound of the spark plug shown in FIG. 3A.
Figure 3C:
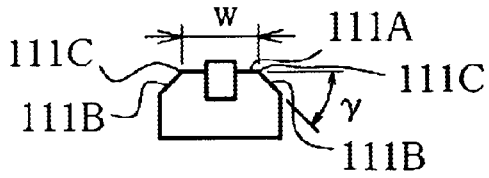
FIG. 3C is a sectional view showing a ground electrode of the spark plug shown in FIG. 3A.

In the present embodiment, K is adjusted to 0.25 mm, whereby the end face 111B of the base member 111 for the ground electrode coincides with the foregoing primary virtual line PVL. As shown in FIG. 2A, the base member 111 for the ground electrode is formed so that the end portion thereof is narrowed towards the end as being limited by tapered planes 111T, 111T placed on both sides along the width-wise direction. The taper angle β is set at approx. 30°, and the end face 111B has a width of approx. 1.4 mm. The width w of the discharge plane 111A which falls within the range WDS resides in a range from 1.40 mm to 1.78 mm. The discharge plane 111A may sometimes have a rounded boundary with the side face 111B of the base member 111 for the ground electrode. In this case, an intersectional line formed by planes extended from the discharge plane 111A and extended from the side face 111B will serve as a boundary line based on which the width of discharge plane 111A is discussed. For an exemplary case in which the ground electrode 11 has a sectional form as shown in FIG. 3C, boundary lines 111C between the discharge plane 111A and tapered side faces 111B appear on the left-hand and right-hand of the drawing, so that the width of the discharge plane 111A is measured as a distance between these two boundary lines 111C, 111C.

Now going back to FIG. 2B, the minimum distance D from the surface of the ground electrode 11 to the surface of the insulator 1 is preferably 1.5 mm or above. Ensuring the minimum distance D as 1.5 mm or above can promote fuel rupture between the ground electrode 11 and insulator 1, so that such portion will be less likely to have the fuel bridge formed therein. When considering mounting on an internal combustion engine, it is not practical for the minimum distance D to exceed 4.5 mm in a spark plug of a generally available size, so that D is preferably set to 4.5 mm or below. It is to be noted now, also in other embodiments described later, that the amount of protrusion F of the insulator 1 from the metal shell 5 is 2.5 mm, and the base member 111 for the ground electrode is 2.5 mm wide and 1.4 mm thick, unless otherwise specifically mentioned.

EXAMPLES

Figure 8:
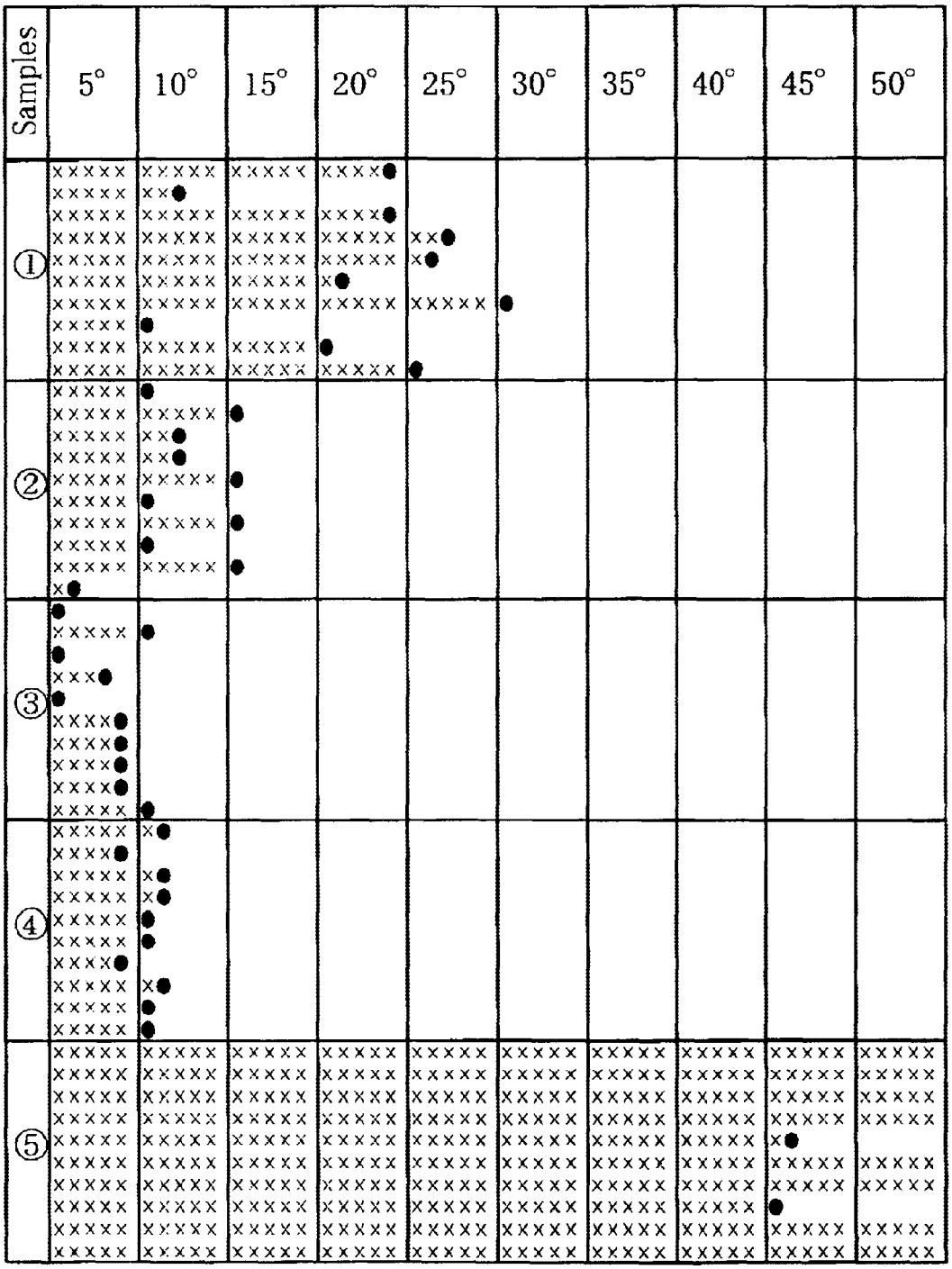
FIG. 8 is a graph showing results of the bridge test.

Experiments for demonstrating effects of the present invention will be described below. Sample Nos. ① to ④ shown in FIG. 8 represent samples according to the embodiments of the present invention, and No. ⑤ represents a comparative example for confirming difference in the effects from those of the samples of the present invention. As for the samples according to the individual embodiments, the description is limited only to points differing from those for the first embodiment. The sample ① according to the first embodiment is such that having the essential portion of which already been shown as being enlarged in FIGS. 2A and 2B. FIG. 2B is a side elevation solely showing the ignition portion of the sample ①, and FIG. 2A is a bottom view of FIG. 2B. The sample ② according to the second embodiment is shown in FIGS. 3A to 3C, which are enlarged views for the principal portion of the sample. FIG. 3B is a side elevation solely showing the ignition portion of the sample ②, and FIG. 3A is a bottom view of FIG. 3B. The sample ② is formed so that the base member 111 for the ground electrode has a trapezoidal section, and narrows the discharge plane 111A opposed to the center electrode 2. The taper angle γ of the trapezoidal portion from the discharge plane 111A is 45°, and the width of the discharge plane 111A within a range between the foregoing primary virtual line PVL and secondary virtual line SVL is approx. 1.8 mm. The width of the discharge plane 111A was measured by a method similar to that in the first embodiment assuming the tapered plane of the base member 111 for the ground electrode as the side face 111B of the ground electrode.

Figure 4A:
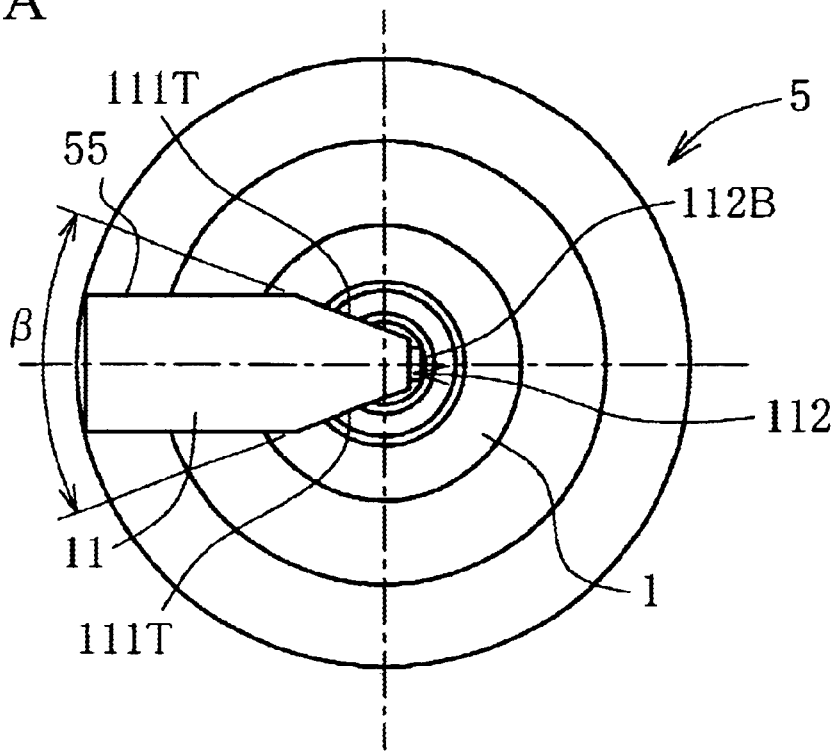
FIG. 4A is a plan view of a spark plug according to the third embodiment of the present invention.
Figure 4B:
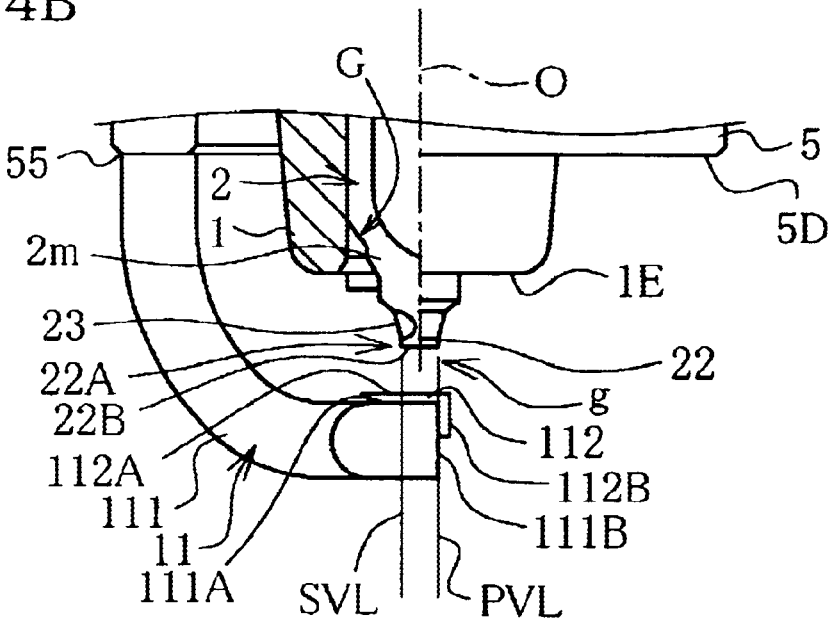
FIG. 4B is an enlarged partial sectional view showing an electrode and therearound of the spark plug shown in FIG. 4A.

The sample ③ according to the third embodiment is shown in FIGS. 4A and 4B, which are enlarged views for the principal portion of the sample. FIG. 4B is a side elevation solely showing the ignition portion of the sample ③, and FIG. 4A is a bottom view of FIG. 4B. The sample ③ is similar to the sample ① except that the noble metal chip 22 on the side of the center electrode 2 is formed with a diameter of 0.4 mm, while all other portion are identical to the sample ①. The width of the discharge plane 111A within the foregoing range WDS resides in a range from 1.40 mm to 1.61 mm, which was measured by a method similar to that in the first embodiment.

Figure 5A:
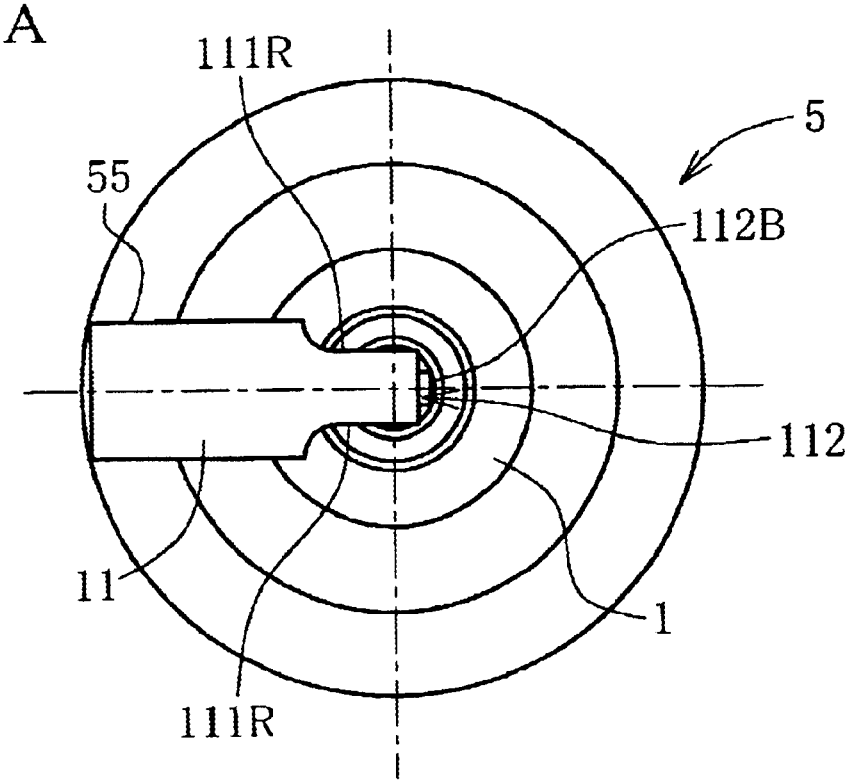
FIG. 5A is a plan view of a spark plug according to the forth embodiment of the present invention.
Figure 5B:
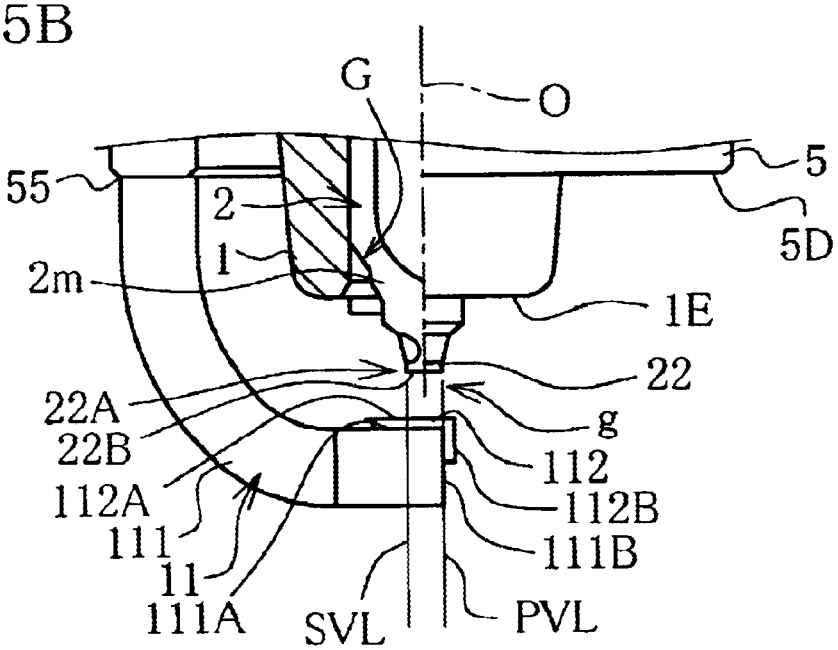
FIG. 5B is an enlarged partial sectional view showing an electrode and therearound of the spark plug shown in FIG. 5A.

The sample ④ according to the fourth embodiment is shown in FIGS. 5A and 5B, which are enlarged views for the principal portion of the sample. FIG. 5B is a side elevation solely showing the ignition portion of the sample ④, and FIG. 5A is a bottom view of FIG. 5B. The sample ④ is formed so that an approx. 2-mm range of the end portion of the base member 111 for the ground electrode is narrowed by notched portions 111R, 111R so as to have an almost regular width of approx. 1.5 mm. In other words, the width of the discharge plane 111A within the foregoing range WDS is set to 1.5 mm. The width of the discharge plane 111A was measured by a method similar to that in the first embodiment.

Figure 6A:
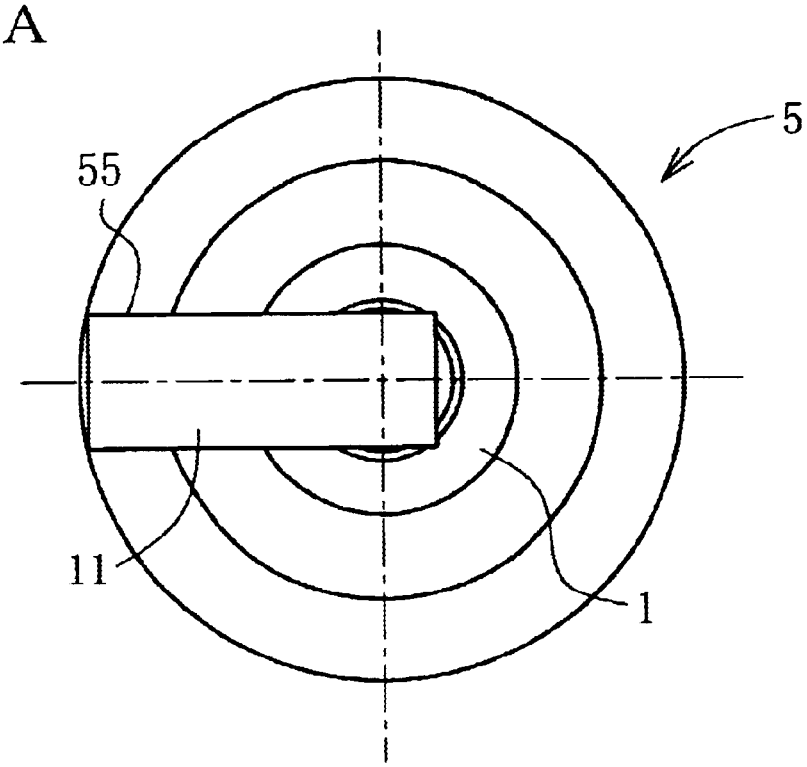
FIG. 6A is a plan view of a conventional spark plug according to a comparative example.
Figure 6B:
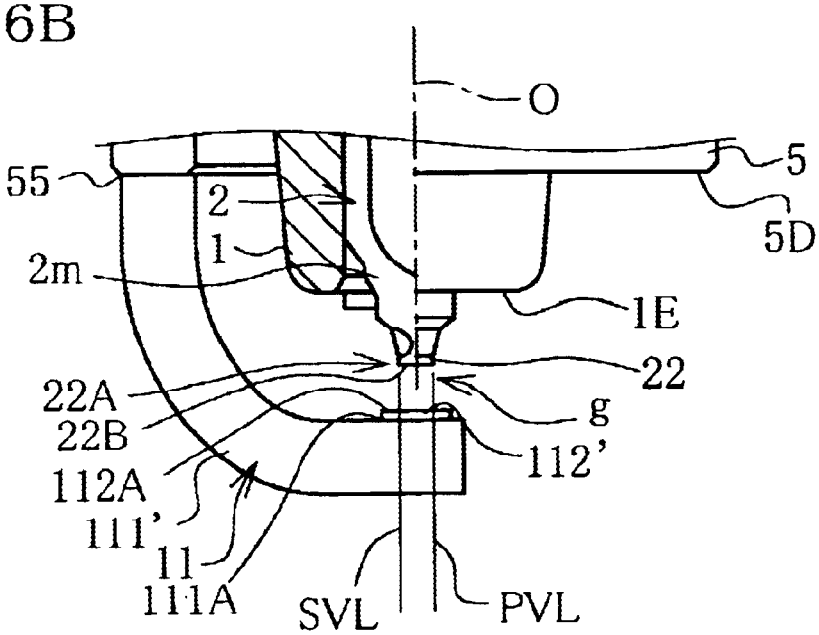
FIG. 6B is an enlarged partial sectional view showing an electrode and therearound of the spark plug shown in FIG. 6A.

Next, the sample ⑤ according to the comparative example is shown in FIGS. 6A and 6B, which are enlarged views for the principal portion of the sample. FIG. 6B is a side elevation solely showing the ignition portion of the sample ⑤, and FIG. 6A is a bottom view of FIG. 6B. In the sample ⑤, a disc-formed noble metal chip 112' is joined to the base member 111 for the ground electrode by resistance welding. The width of coverage K is set to 0.6 mm in order to make the noble metal chip 112' to oppose to the noble metal chip 22 on the side of the center electrode 2, and also to ensure a desirable joining with the base member 111' for the ground electrode. The width w of the discharge plane 111A within the foregoing range WDS is 2.5 mm corresponding to the width of the ground electrode, which was measured by a method similar to that in the first embodiment.

Figure 7:
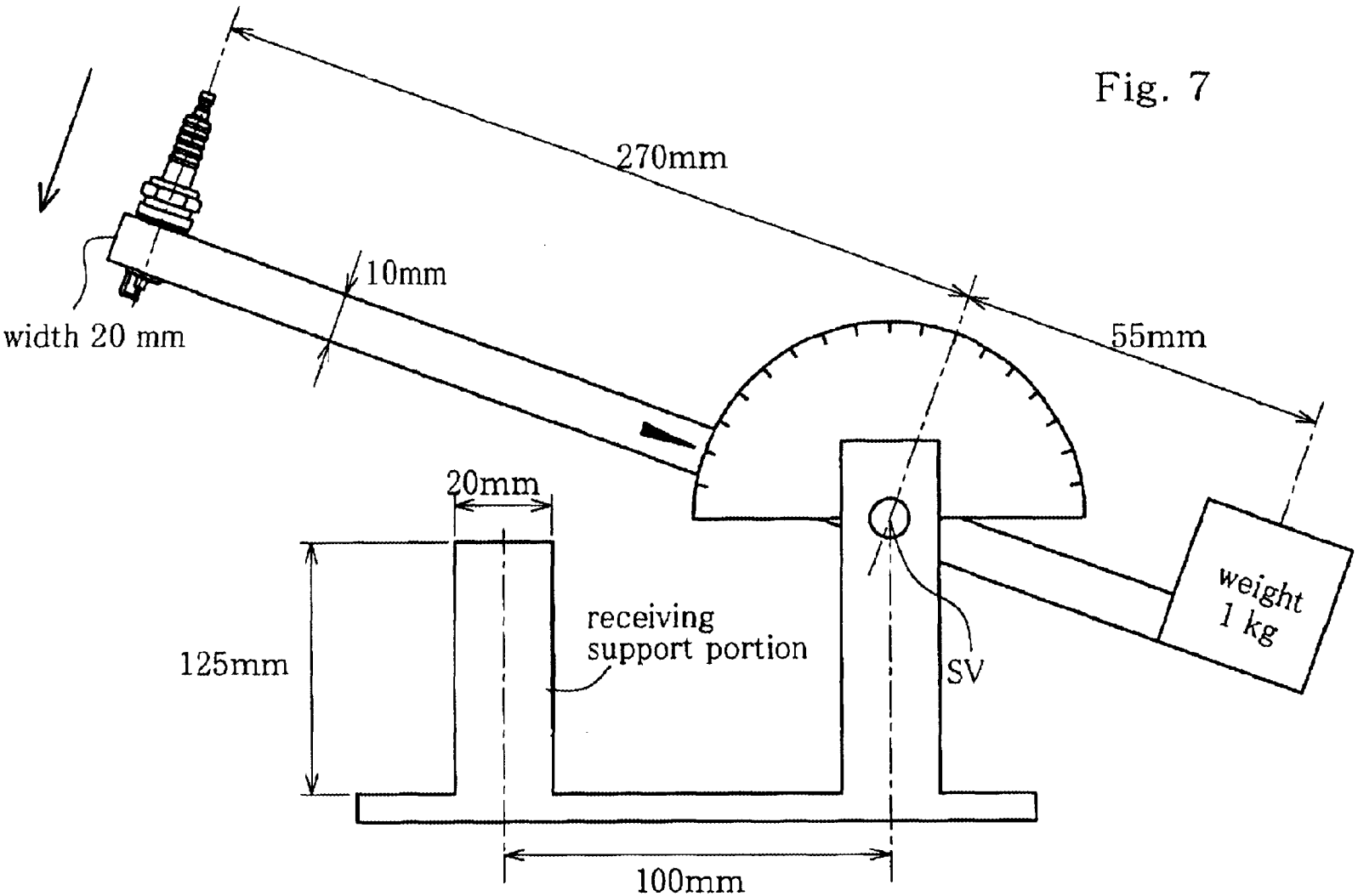
FIG. 7 is a schematic drawing showing an entire portion of a bridge testing device.

These samples were then evaluated by the fuel bridge test described below. In this experiment, water was used in place of gasoline generally used in internal combustion engine. This is because the fuel bridge generated in the spark discharge gap is usually discussed in terms of its readiness of rupture in a very-low-temperature status, that is, in a state that viscosity of the fuel is lowered. Since water at normal temperature is known to have a viscosity equivalent to that of gasoline at −40° C., water is one of the most convenient substituents for confirming the readiness of rupture of fuel bridge, which is a major object of the present invention. First, each sample was mounted on an arm of a fuel bridge testing device as shown in FIG. 7, and approx. 0.05 ml of water was allowed to adhere at the spark discharge gap using a syringe. The arm was inclined, then allowed to fall freely towards a receiving support portion, and whether the bridge was ruptured or not was observed for every fall. The arm comprises a beam-formed member made of a hardened steel having a rectangular section and dimensions as indicated in the drawing, and the supporting portion which serves as an impact receiver comprises a prismal member made of a soft steel having a 20 mm×20 mm section. The distance from the fulcrum of turn SV of the arm to the contact point with the receiving support portion (geometric center of gravity in the end face of the receiving support portion) measures 100 mm. Ten each of the individual samples ① to ⑤ were tested. None of the samples was not supplemented with water.

Results of the test were shown in FIG. 8. Angle of inclination of the arm was increased from 5° by 5°, and the test was carried out maximum 5 times for each angle. Symbol ● indicates the angle which caused rupture of the bridge and that at what number of time such rupture was observed. Symbol X indicates that no rupture of the bridge was observed. For exemplary cases for the sample ①, one sample resulted in the rupture of bridge for the first time at an angle of 10°, one sample for the third time at 10°, one sample each for the first and second times at 20°, two samples for the fifth time at 20°, one sample each for the first, second and third times at 25°, and one sample for the first time at 30°. In contrast for the cases for the comparative sample ⑤, two samples results in the rupture for the first and second times at 45°, but eight residual samples did not result in the rupture even after 5 times of the measurement at an angle of as large as 50°. The results indicate that the sample ③ is most likely to cause rupture of the bridge.

Figure 9:
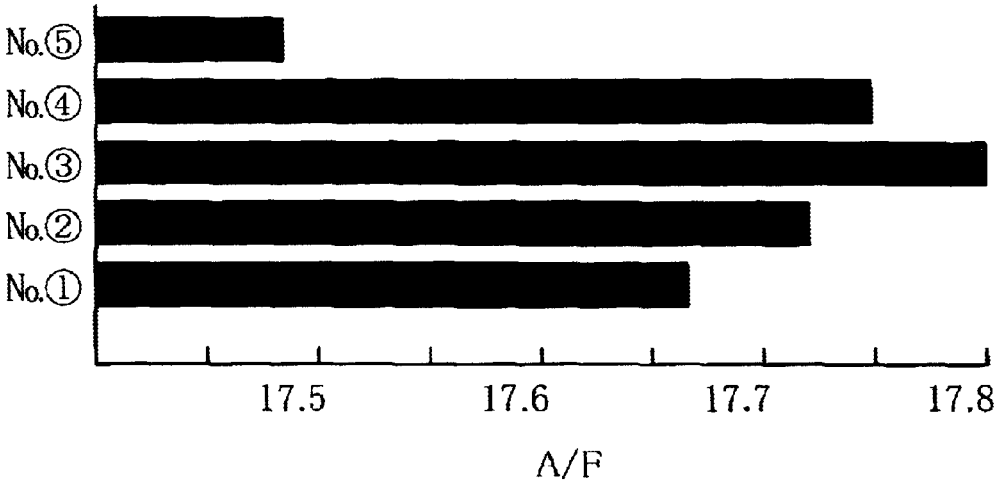
FIG. 9 is a graph showing results of ignition property test.

Ignition property test was then carried out using the samples ① to ⑤ of the same shape. This provides indices for assessing readiness of ignition of fuel in a combustion chamber. The test was conducted using one cylinder of an in-line, six-cylinder engine having a displacement of 2 litters under a fuel mixing ratio shifted to the lean side and at an idling engine speed of 700 rpm. Under such engine conditions, an air-fuel ratio (A/F) causing HC spike ten times per 3 minutes was judged as an ignition limit. Results were shown in FIG. 9. The results indicate that the sample ③, whose noble metal chip 22 on the center electrode 2 has a diameter as smallest as 0.4 mm, showed an excellent ignition property.

Figure 10:
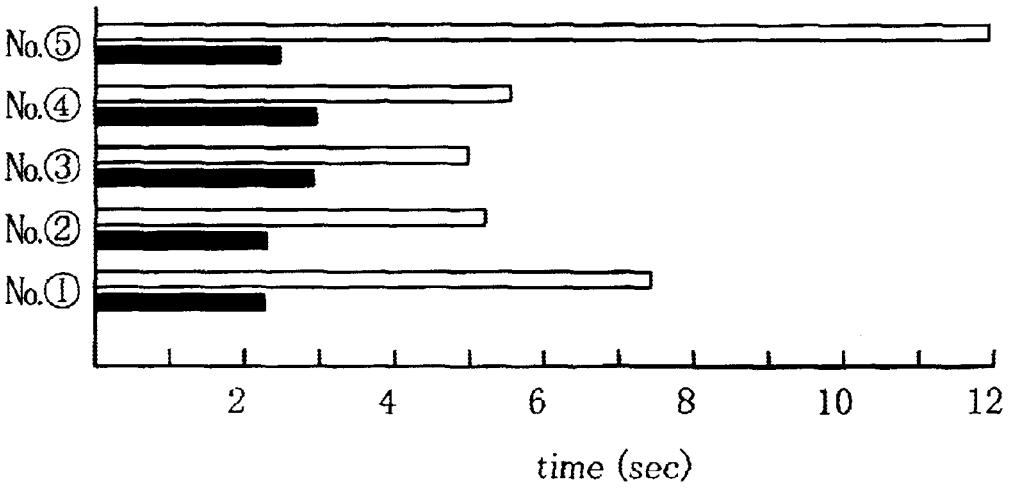
FIG. 10 is a graph showing results of low-temperature startability test.

Low-temperature startability test was further carried out using the samples ① to ⑤ of the same shape. In this test, initial explosion time and complete explosion time were compared in a freezing resistance test room at −30° C. using an in-line, six-cylinder engine having a displacement of 2 litters. The initial explosion time herein refers to a length of time from the beginning of the cranking to a point of time the first pressure rise due to ignition occurs in any one of the cylinders, and the complete explosion time refers to a length of time from the beginning of the cranking to a point of time from thereon the internal combustion engine can maintain its rotation without being assisted by the cranking. Results were shown in FIG. 10. It is known from the results that especially the sample ③ has an excellent startability while the samples ② to ④ gave equivalent results. Comparison of the results of the fuel bridge test shown in FIG. 8 with these results reveals that those giving better results in the fuel bridge test can give better results of the startability at an extremely low temperature as low as −30° C., which suggests a strong correlation between the both.

FIG. 11 shows results of the similar fuel bridge test using spark plugs having various combinations of the width of discharge plane within a range WDS and the width of coverage K. Five each of the individual spark plugs were tested, and those showing an average angle causing rupture of the bridge of 20° or less were assessed as excellent (◎), those exceeding 20° but not larger than 30° as good (○), and those exceeding 30° as no good (X). It is known that good results of suppression of the bridge formation were obtained when the relation of $w<2.1-K$ (in mm) is satisfied, and further good results were obtained for $w<1.7-K$.

(Other Embodiments)

The present invention explained in the above is by no means limited to the foregoing embodiments, and it is to be understood that the present invention is of course applicable after being properly modified without departing from the spirit thereof. Although the above description typically dealt with the case in which the protruded portion 112 of the ground electrode 11 protrudes ahead of the discharge plane 111A by only 0.25 mm, it has already confirmed that the amount of protrusion of 0.5 mm or above is more beneficial to achieve the effects of the present invention. Although the above description typically dealt with the spark plug in which the diameter of the center electrode is reduced (so-called thermo-edge) by two steps within the end portion of the insulator, the present invention is also applicable to spark plugs having no thermo-edge, or having only one step of shrinkage of the diameter.

What is claimed is:

1. A spark plug comprising:

an insulator (1) having a center through hole (1D);

a center electrode (2) disposed in said center through hole (1D) and extends along the direction of axial line (O);

a metal shell (5) having a screw (5B) for assembling an internal combustion engine provided external of said insulator (1); and a ground electrode (11) joined at one end thereof through a joint portion (55) to said metal shell (5), and on the other end of which having a discharge plane (111A) being arranged so as to oppose to an end face (22B) of said center electrode (2) to thereby form a spark discharge gap (g), wherein said insulator (1) is engaged to said metal shell (5) through an engagement portion (15), and said center electrode (2) is protruded out from an end face (1E) of the insulator (1) and has formed therein a divergent portion (G), having a diameter increasing towards the end, on the end side beyond said engagement portion (15) and between the outer peripheral surface of the center electrode (2) and the inner peripheral surface of the insulator (1); and the end of said center electrode (2) forming said spark discharge gap (g) comprises a noble metal member (22) having a straight rod portion (22A) of 1.0 mm or less in diameter and 0.2 mm or more in length;

assuming a primary intersectional line (PKL) as being defined as an intersectional line formed between said end face (22B) of said center electrode (2) or a plane (P1) extended therefrom and a lateral plane (22S) of said straight rod portion (22A) or a cylindrical plane (C1) extended therefrom;

further assuming a secondary intersectional line (SKL) as being defined as an intersectional line formed between said discharge plane (111A) or a plane (P2) extended therefrom and an end face (112B) of said ground electrode (11) or a plane extended therefrom;

further assuming a primary virtual line (PVL) as being defined as a virtual line containing a primary intersectional point (PP) and being in parallel to a virtual center axial line (O) of the spark plug referring to said screw (5B) for assembling the internal combustion engine, said primary intersectional point (PP) being a first point encountered said primary intersectional line (PKL) when a standard line (SL) parallel to said virtual center axial line (O) is moved across said spark discharge gap g to the joint portion 55 of the ground electrode 11 from the side opposite to such joint portion 55 placing the virtual center axial line O in between; and further assuming a secondary virtual line (SVL) as being defined as a virtual line containing a secondary intersectional point (SP) and being in parallel to said virtual center axial line (O), said secondary intersectional point (SP) being a last point where the standard line (SL) similarly moved intersects with said primary intersectional line (PKL);

a width of coverage (K) as being defined as a distance between the primary virtual line (PVL) and secondary intersectional line (SKL) is set so as to satisfy a relation of $-d \leqq K \leqq 0.5$ (in mm: where d represents the diameter of the end face (22B) of said center electrode (2); and sign for K is defined as negative when the secondary intersectional line (SKL) stands closer to the joint portion (55) than the primary virtual line (PVL), and as positive when stands further); and the width (w) of a portion of said discharge plane (111A) which falls within a range (WDS) between the secondary virtual line (SVL) and primary virtual line (PVL) satisfies a relation of $w<2.1-K$ (in mm) where K is the foregoing width of coverage.

2. The spark plug according to claim 1, wherein said width (w) of a portion of said discharge plane (111A) which falls within a range (WDS) between the secondary virtual line (SVL) and primary virtual line (PVL) satisfies a relation of $w<1.7-K$ (in mm) where K is the foregoing width of coverage.

3. The spark plug according to claim 1, wherein the discharge plane (111A) of said ground electrode (11) has formed thereon, at a position opposed to said end face (22B) of the center electrode (2), a rectangular protruded portion (112) protruded from the surface of the base member of said ground electrode (11), which composes said discharge plane (111A), towards said center electrode (2).

4. The spark plug according to claim 3, wherein the area of an end face (112A) of said protruded portion (112) is larger than the area of the end face (22B) of the center electrode (2).

5. The spark plug according to claim 3, wherein said protruded portion (112) is protruded from the surface of the base member of the ground electrode by 0.5 mm or above.

6. The spark plug according to claim 2, wherein said protruded portion (112) is made of a noble metal member.

* * * * *